US007288749B1

(12) United States Patent
Kominar et al.

(10) Patent No.: US 7,288,749 B1
(45) Date of Patent: Oct. 30, 2007

(54) ELECTRICAL HEATING DEVICE AND METHOD OF ITS MANUFACTURE

(76) Inventors: Vladimir Kominar, P. O. Box 10356, 84100 Beer-Sheva (IL); Irina Loktev, 13/16 Sayeret Duhifat St., 97530 Jerusalem (IL); Igor Papirov, 10/6 Imre Kalman St., 97530 Jerusalem (IL)

( * ) Notice: Subject to any disclaimer, the term of this patent is extended or adjusted under 35 U.S.C. 154(b) by 0 days.

(21) Appl. No.: 11/192,238

(22) Filed: Jul. 29, 2005

Related U.S. Application Data

(60) Provisional application No. 60/592,226, filed on Jul. 30, 2004.

(51) Int. Cl.
*H01C 3/00* (2006.01)
*H05B 3/54* (2006.01)

(52) U.S. Cl. ..... 219/544; 219/539; 219/541; 219/213; 219/466.1; 219/549; 338/279; 338/280; 338/281

(58) Field of Classification Search ..... 392/435; 338/279, 280, 281, 282; 219/541, 539, 213, 219/552, 466.1, 549
See application file for complete search history.

(56) References Cited

U.S. PATENT DOCUMENTS 1,226,627 A * 5/1917 Barnum ..... 338/281
4,574,186 A * 3/1986 Sakai et al. ..... 219/528
5,641,421 A * 6/1997 Manov et al. ..... 219/553
5,724,479 A * 3/1998 Takahashi ..... 392/496
6,118,102 A * 9/2000 Slegt ..... 219/438
6,184,502 B1 * 2/2001 Haazendonk ..... 219/460.1
6,353,707 B1 * 3/2002 Loktev et al. ..... 392/435
2003/0052121 A1 * 3/2003 Sopory ..... 219/505
2003/0102304 A1 * 6/2003 Boyers ..... 219/628
2004/0175164 A1 * 9/2004 Loktev et al. ..... 392/436

FOREIGN PATENT DOCUMENTS

WO WO 200149759 A1 * 7/2001

* cited by examiner

*Primary Examiner*—Tu Ba Hoang
*Assistant Examiner*—Stephen J. Ralis
(74) *Attorney, Agent, or Firm*—Renner, Otto, Boisselle & Sklar, LLP

(57) ABSTRACT

An electric heating device based on a ribbon of crystalline metal foil with high specific resistance, which is additionally treated to increase its plasticity and/or additionally coated with a mold release agent to enhance compatibility of the ribbon and insulating envelope. The ribbon combines high electrical resistance, high stability, sufficient mechanical strength and relative cheapness with very important properties including significant plasticity and compatibility with insulating polymers, including rubber and silicone. The above compatibility provides high reliability and life span. Different structures for flexible and rigid heaters on the basis of this ribbon are described, as are different applications.

18 Claims, 5 Drawing Sheets

ELECTRICAL HEATING DEVICE AND METHOD OF ITS MANUFACTURE

FIELD OF THE INVENTION

The present invention generally relates to electric heating devices based on heating resistance metal ribbons with increased plasticity intended for wide range of applications: industry, agriculture, medical equipment, radiant heating of premises, under floors and ceiling heating, etc.

The electrical heating devices are designed for large range of application: flexible and rigid, with voltage range from 3V up to 400V, with specific power from 50 W per square meter up to 100 kW per square meter (for water heating).

BACKGROUND OF THE INVENTION patent U.S. Pat. No. 6,353,707 discloses an electric heating device on base of the ribbon. The ribbon extends along the device and is bent in a plurality of locations, where the ribbon has an electro-conductive coating for mechanically strengthening and electrically shunting it in these locations. U.S. Pat. No. 6,353,707 describes also heating devices comprising an insulating rigid or flexible shell and a flat continuous heating resistance foil ribbon disposed inside the shell.

PCT patent Application WO 03/017721 A2 and U.S. patent application Ser. No. 10/367,742 on its base "Electrical Heating Device" disclose an electric heating device including a flexible resistance ribbon of special alloy composition with close limits of components, fastened to fiberglass or plastics net by glued tapes or spots, forming insert, which is incorporated in different plastics shells. It is described different structures of plastics heaters based on this inserts.

SUMMARY OF THE INVENTION

An electric heating device in accordance with the present invention is based on a heating resistance ribbon of crystalline cold rolled metal foil with thickness less than 100 microns. Preferably, the heating resistance ribbons are formed from wide range of alloys compositions with high specific resistance, particularly from combinations of Fe—Cr—Al—Ni as the cheapest. For one of examples, alloy with electrical resistance $0.98*10^{-6}$-$1.05*10^{-6}$ Ω*m consists of: Cr content is (19-21)%, Ni content is (19.5-21.5)% and Al content is (1-1.5)%.

For large range of applications the main requirements to the high resistance ribbon are: electrical resistance stability, mechanical strength and plasticity for bending of the ribbon. The ribbon is arranged in required pattern in different dimensions and shapes, and in many cases the ribbon is used being bent at any angle with radius of ribbon bending equal zero. Therefore, the ribbon must meet the requirements of very high plasticity providing ability to be bent and arranged by any pattern. In some applications bending places exist under conditions of pressure. Such conditions arise, for example, in hermetically closed electrical heating devices for water heating.

However standards ribbons from Fe—Cr—Al—Ni alloys don't provide such level of plasticity. In accordance with standards, minimum bending diameter equals triple thickness of the ribbon. For achievement of this purpose U.S. Pat. No. 6,353,707 proposes using of electro-conductive coating (for example, copper coating) in a plurality of ribbon locations, where the ribbon will be bent. This coating is plotted by electroplating method. This method provides performing of pointed task, but it is enough complicated in industry realization. U.S. patent application Ser. No. 10/367,742 describes one of alloy compositions of Fe—Cr—Al type with components content in very close limits, which possesses by most plasticity from alloys of this family. However, even this alloy needs in additional treatment, especially for pressed bent places.

It is known a method of plasticity improving of the foil ribbon. This property may be reached by additional thermal treatment (coil annealing): heating up to temperature 740-760° C. and quick cooling. Using of this process before latest cold rolling is unacceptable for rolling plant because the alloy will be covered by solid oxide, which provokes rolls destroy. Using of described coil annealing method after latest cold rolling is also unacceptable, because it reduces mechanical strength of the ribbon.

The present invention proposes solution of the alloy plasticity problem. In accordance with this invention, the electrical heating device contains the heating resistance ribbon of crystalline cold rolled metal foil with thickness 100 microns and less formed from wide range of alloys with high specific resistance, particularly from combination of Fe—Cr—Al—Ni. The heating resistance ribbon contains along its length short sections subjected to additional local plasticizing processing. These sections have increased plasticity, allowing to bend the ribbon at the angle within 0-180°, and the heating resistance ribbon is capable of reusable bending and further pressing with radius of ribbon bending equal zero. Length of these sections equals approximately to the length of bended ribbon parts.

Method of manufacturing of metal foil ribbon with improved plasticity includes additional local plasticizing processing after traditional cold-rolling process. The plasticizing processing includes local non-contact inductive high frequency thermo-treatment of the above mentioned short sections. Such treatment allows to avoid ribbon strength reducing and to reach required local plasticity level. The additional plasticizing processing comprises passing of the ribbon through high frequency electromagnetic field formed by an inductor. Electromagnetic field is impressed to the above mentioned ribbon sections only. This is reached by forming of high frequency pulses bursts. Power and duration of the pulses bursts are adjusted by control system. Specific power of the electromagnetic field impressed to the ribbon is within 2.0-6.0 W/cm$^2$. Duration of said thermo-treatment is not less 0.1 sec. per cm of the section length. The inductive high frequency current provides quick local heating of the ribbon sections up to temperature 740-760° C.

The method of manufacturing of metal foil ribbon with improved plasticity including additional local plasticizing processing after traditional cold-rolling process is realized by the following steps:

setting of the ribbon such that the ribbon will cross electromagnetic field generated by a high frequency current inductor during ribbon rewinding;

setting of adjusted line speed of the ribbon;

forming of high frequency pulses bursts by the inductor control system; frequency of the bursts $F_{burst}$ is regulated according with formula: $F_{burst}<=1/(t_{burst}+t_{pause})$, where $t_{burst}$—duration of high frequency pulses burst equal to relation of the length of the section and the ribbon line speed upon rewinding, $t_{pause}$—time interval between high frequency pulses bursts equal to relation of the length of ribbon between said sections and the ribbon line speed;

rewinding of the ribbon from the first bobbin (bobbin-source) to the second bobbin (bobbin-receiver); a line speed of the ribbon is adjusted preliminary.

Performed tests show that after additional plasticizing processing the ribbon stand to bending even under conditions of compression. The ribbon also meets the requirements of reusable bending on the same bending place. Such property is very important for heaters production.

The present invention proposes also one yet method of local ribbon treatment, which allows to reduce specific power of electromagnetic field and duration of high frequency impulses burst, i.e. to increase line speed of the ribbon. In accordance with this method, before additional local plasticizing processing the ribbon is heated up to initial temperature not exceeding 300° C.-350° C. and only after heating the ribbon is treated by high frequency electromagnetic field. In this case specific power of the electromagnetic field is in limits 1.0-3.0 W/cm$^2$, and impulses burst duration is not less 0.05 sec. per cm of the section length. Increasing of initial temperature higher then 370° C. may provoke into structural changes of Fe—Cr—Al—Ni alloy.

This invention presents also the electrical heating device, which contains the electrical heating resistance ribbon made of a crystalline cold rolled metal foil with thickness 100 microns and less formed from high resistive alloy particularly containing combination of Fe—Cr—Al—Ni. The electrical heating resistance ribbon is coated by liquid or spray substance selected of group of fluoropolymer mold releases. This coating is separating layer between the ribbon and molding mass, which simultaneously increases radius of the ribbon bending.

A further aspect of the present invention is a heating device, which consists of above mentioned electrical heating resistance ribbon subjected to additional local plasticizing processing, arranged in any required pattern and being bent at any angle with radius of ribbon bending equal zero. The bending places are disposed on the sections subjected to additional processing. The ribbon is provided by connectors on its ends for connecting with power source.

In another design the heating device consists of the electrical heating resistance ribbon, wherein the electrical heating resistance ribbon is coated by liquid or spray substance selected of group of fluoropolymer mold releases. This coated ribbon is arranged in any required pattern and being bent at any angle. The arranged foil ribbon is provided by connectors on its ends for connecting with power source, and this arranged ribbon with connectors is adapted for molding by melting inorganic (as gypsum, concrete, cement) or polymer mass.

As distinct from known heaters, firstly, these heating devices are made of the above mentioned electrical heating resistance ribbon with high level of plasticity and, secondly, free of any adhesive materials fastening the ribbon to any base. Different adhesive materials, including glued tape, glue spot, etc. used for the fastening of the electrical heating resistance ribbon to any base cause of some swellings on device surface. These swellings arise from gas nascent at hot pressing, laminating or other processes.

Forming of heating devices, which don't contain any adhesives, allows to avoid pointed swellings.

Described heating devices are realized owing to using of manufacturing method, wherein the electrical heating resistance ribbon (both coated and not coated) is arranged in any required pattern without fastening to any support material on an electromagnetic table. Assembling of the structures is realized by the following steps:

laying of packaging materials (for example, paper sheet, film) on electro-magnetic table;

laying of support materials (for example, mesh, plastic sheet, etc.) on packaging materials;

switching on the electromagnetic table;

laying of said electrical heating resistance ribbon in required pattern on support material or packaging materials, if the support material is absent;

laying of the second layer of support materials;

switching off of the electromagnetic table;

transportation of the support and packaging materials for subsequent processing (coating, molding, impregnation, pressing, vulcanization) and laying of the following materials.

The present invention further proposes the electrical heating device, wherein the electrical heating resistance ribbon is arranged in desired pattern and is placed between two additional layers of mesh as support material. This sandwich is coated by two coatings. The first of them is non sealing liquid or spray substance selected of group of fluoropolymer mold releases. The second of them is non sealing liquid or spray substance of rubber group. The coatings carry out simultaneously three functions: preserves against conglutination of the heating resistance ribbon with any molding mass, fastens mesh layers without adhesive materials and provides keeping of mesh holes, which are necessary for further impregnation by molding mass. The electrical heating resistance ribbon and coated mesh forms the heating device with reinforcing base, which is ready for impregnating by inorganic and organic materials in large range of temperatures.

Described structures are effective for silicone or rubber heating devices. In this case electric insulating layers of the heating device are formed of silicone or rubber raw materials, and the electrical heating resistance ribbon, both with mesh and without it, is placed between these layers for further pressing and polymerization (vulcanization).

One of preferred variants is a structure, wherein the electrical heating resistance ribbon is arranged in desired pattern and is placed between two additional layers of flexible rubber magnet sheets. Using of flexible rubber magnet sheets as envelops of the hating device allows to fasten easily and tightly the heating device to iron based metal heated surface (for example, pipes, tanks, balloons, containers, etc.). In such applications providing of maximum heat transfer between the heating device and heated surface is one of the main requirements. Therefore, tight fastening is very important. Besides, the flexible rubber magnet sheet serves for facilitation of the heating ribbon arranging process.

In another structure the electrical heating resistance ribbon, both with mesh and without it, is molded by different polymer mass. For example, epoxy or polyester resins are used as molding materials.

One of preferred variants is a structure, containing the electrical heating resistance ribbon and a fiber reinforced polymer for molding and subsequent pressing. For example, the heating plates obtained after pressing of fiber glass reinforced polyester resin with the electrical heating resistance ribbon show very high quality and long life span.

Other design of the described heating device contains the electrical heating resistance ribbon arranged in desired pattern and additional two layers of thermoplastic polymer sheets (for example, PVC). This electrical heating resistance ribbon is placed between them. Thermoplastic layers are fastened between them by gluing and pressing.

The present invention disclosures the electrical heating device containing the electrical heating resistance ribbon coated by liquid or spray substance selected of group of fluoropolymer mold releases, which is covered by thermoplastic polymer (for example, PVC, polyethylene) forming a long linear heating strip. This covering is realized during laminating process.

The present invention disclosures also the electrical heating device containing the electrical heating resistance ribbon coated by liquid or spray substance selected of group of fluoropolymer mold releases, which is placed inside thermoplastic jacket (for example, PVC, polyethylene) forming a long linear heating strip. This electrical heating device is realized during extrusion process. The thermoplastic jacket consists of one or more extruded layers. In the case of multilayered jacket, the thermoplastic layers are bound between them, and the heating resistance ribbon is tightly covered, but not bound with the thermoplastic jacket.

The present invention contains description of different structures of rigid radiant heaters. One of preferred variants is the electrical heating device, containing the electrical heating resistance ribbon arranged in desired pattern and a rigid sheet as a base (for example, ceramic tiles, gypsum panels, rigid plastic panels, natural and synthetic marble, metal sheet, etc.). This electrical heating resistance ribbon is placed on this base and is fastened to the base by resin (for example, epoxy or polyester). The layer of the resin forms simultaneously the electrical insulating layer.

Another structure of the electrical heating device contains two rigid sheets (for example, gypsum panels, rigid plastic panels, natural and synthetic marble, metal sheet, etc.) and the electrical heating resistance ribbon between them. These rigid sheets and the electrical heating resistance ribbon are fastened between them by insulating resin (for example, epoxy or polyester).

Described rigid electrical heating devices may be built also as the following structure: rigid sheet as a base (for example, ceramic tiles, gypsum panels, rigid plastic panels, natural and synthetic marble, metal sheets, etc.), the electrical heating resistance ribbon placed between two additional layers of mesh, and a layer of resin (for example, epoxy or polyester), which fastens the structure and serves as electrical insulation.

In the present invention it is proposed the electrical heating device, wherein the electrical heating resistance ribbon is placed between two additional metal plates with powder or enamel coating, and these plates are tight fastened between them and sealed by a gasket. This electrical heating device is waterproof heater, which may be used in large range of voltage (6-400 V) and specific power.

The electrical heating device is designed also for water heating in tanks (boilers). Application of such heating devices with large area allows avoid salts precipitation on the heating devices surface and provides improved circulation of water.

The present invention aims to obtain heating devices with wide range of applications, dimensions, forms and specific power, with high reliability and long life span.

All these goals can be attained using the proposed electrical heating resistance ribbon with proposed thermo-treatment and coating and different structures on its base.

The present invention provides technical solutions, which are innovative and capable of meeting the requirements for their application. The technical solutions are fit for industrial production, and as formulated in the present patent application, constitute a coherent invention.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

The invention shows different variants of using electrical heating devices based on the electrical heating resistance ribbon from crystalline cold rolled metal foil with thickness 100 microns and less. One of the most important characteristics is ability to be bent with any angle and bending diameter decreased up to zero. Using of low alloyed cheap foil from Fe—Cr—Al—Ni family requires additional steps for reliable bend-ability providing. Therefore presented invention proposes using of electrical heating resistance ribbon from crystalline cold rolled metal foil treated by additional local plasticizing processing. This ribbon contains along its length short treated sections. These sections have increased plasticity, allowing to bend the ribbon at the angle within 0-180° with diameter of ribbon bending less than triple thickness of the ribbon and even practically equal zero with subsequent pressing.

Figure 1:
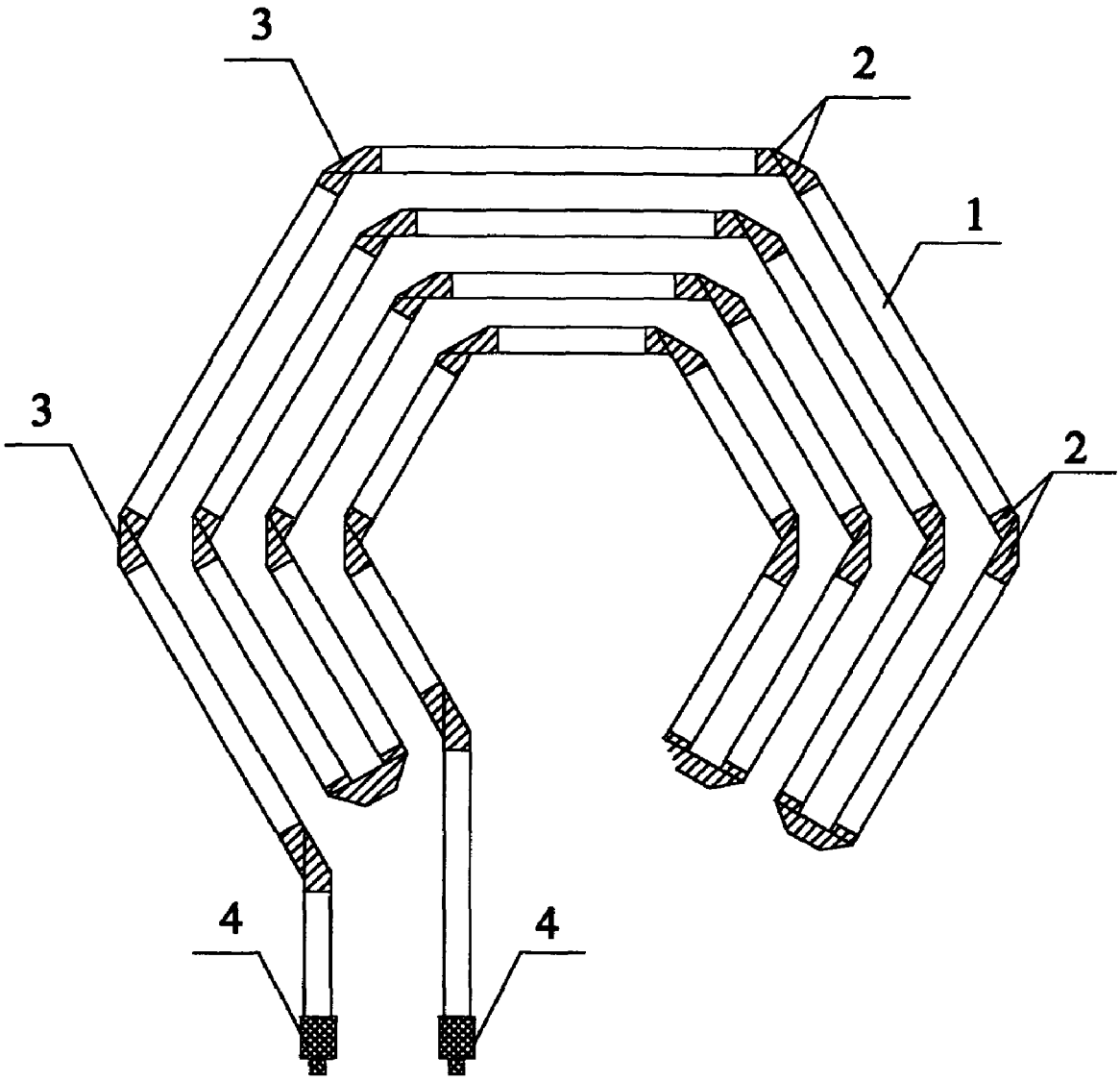
FIG. 1 is schematic view of one embodiment of an electrical heating resistance ribbon arranged in one desired pattern in accordance with the present invention.

FIG. 1 shows the ribbon with above mentioned sections. In FIG. 1 the ribbon 1 contains treated sections 2 in bending places 3. Length of these sections is about the length of a bent places.

Figure 2:
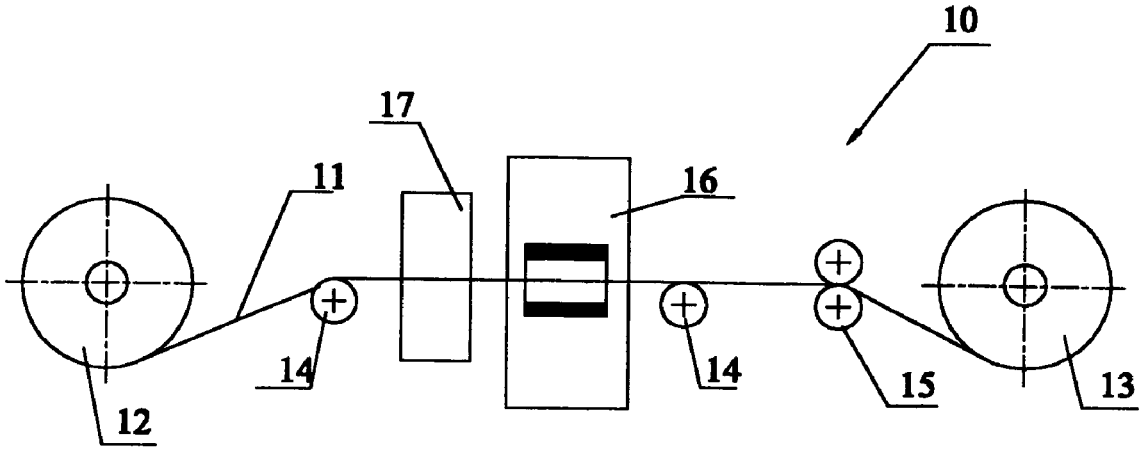
FIG. 2 is schematic view of one of suitable technological plants for plasticizing processing in accordance with the present invention.

In presented invention it is described method of manufacturing of the metal ribbon with increased plasticity. After traditional cold-rolling process the ribbon undergoes to the additional local plasticizing processing. FIG. 2 shows one of suitable technological plants. This plant 10 contains rewinding unit of the ribbon and high-frequency inductor. The ribbon 11 is wound from a bobbin-source 12 to a bobbin-receiver 13. Rolls 14 maintain the ribbon in strained state. Adjusting rolls 15 set the line speed of ribbon. The ribbon 11 crosses electromagnetic field generated by the high-frequency inductor 16. Control system of the inductor 16 forms bursts of high-frequency pulses. Power and duration of the pulses bursts is forming in dependence on thickness and wide of foil, line speed of the ribbon and length of the sections of bending. Specific power of the electromagnetic field impressed to the ribbon is within 2.0-6.0 W/cm$^2$. Duration of the bursts for warming of bending places up to temperature 740-760° C. is not less 0.1 sec. per cm of the section length.

The method includes the following steps: setting of the ribbon 11 such that the ribbon will cross the electromagnetic field generated by high frequency inductor 16 during the ribbon rewinding; setting of required speed of rotation of adjusting rolls (rolls 15) and accordingly of line speed of the ribbon 11 $V_{ribbon}$ (FIG. 3) forming and turning on the high-frequency pulses bursts such that frequency of the pulses bursts $F_{burst}$ is regulated in accordance with formula: $F_{burst}=1/(t_{burst}+t_{pause})$, where $t_{burst}$ is impulse burst duration equal to relation of the length of the section $L_0$ (FIG. 3) and the ribbon line speed upon rewinding $V_{ribbon}$, $t_{pause}$—time interval between pulses burst equal to relation of the length of ribbon between said sections $L_1$ (FIG. 3) and the ribbon line speed $V_{ribbon}$; rewinding of the ribbon 11 from the first bobbin (bobbin-source 12) to the second bobbin (bobbin-receiver 13) with adjusted line speed of the ribbon.

FIG. 2 shows also technological plant 10 with additional chamber 17 for the ribbon preliminary warming. In this case the ribbon is preliminary warmed up to temperature 300-350° C. After stage of preliminary warming, the ribbon crosses electromagnetic field. In this case specific power of electromagnetic field is reduced and it is within 1.0-4.0 W/cm$^2$, and bursts duration is not less 0.05 sec. per cm of the section length.

Figure 3:
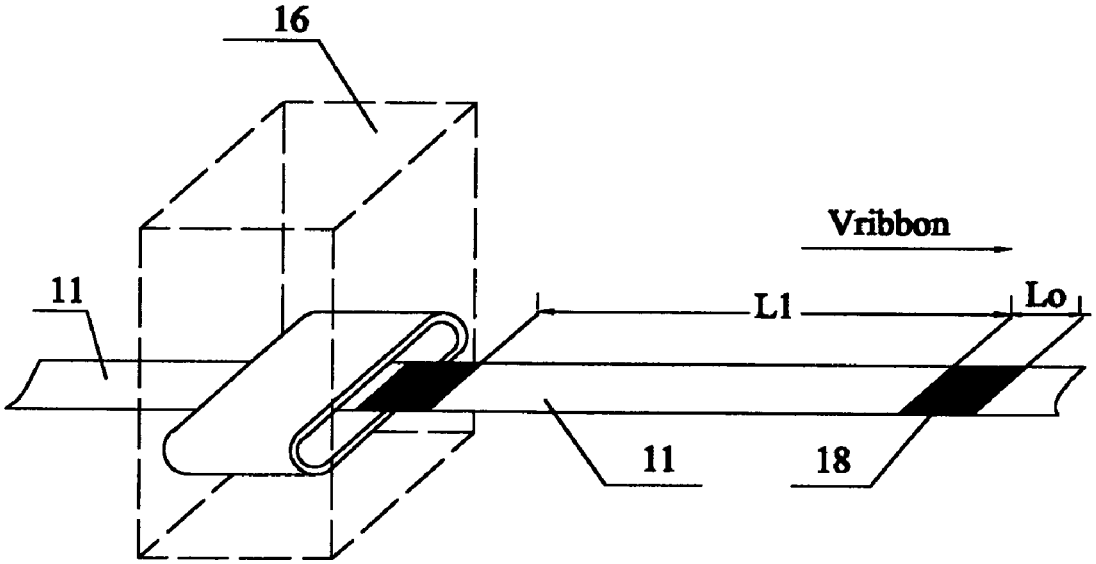
FIG. 3 is schematic view of high-frequency inductor for plasticizing processing with additional warming chamber in accordance with the present invention.

FIG. 3 illustrates this process. The ribbon 11 passes high frequency electro-magnetic field generated by inductor 16. The ribbon has the treated sections 18.

After described plasticizing processing, the electrical heating resistance ribbon is ready to using.

The heating ribbon of Fe—Cr—Al—Ni foil may be covered by additional coating of liquid or spray substance selected of group of fluoropolymer mold releases, which is separating layer between the ribbon and molding mass and simultaneously increases diameter of the ribbon bending.

On base of described electrical heating resistance ribbons the heating devices may be formed. As it is illustrated by FIG. 1, the heating device consists of the electrical heating resistance ribbon 1 subjected to additional processing and arranged in any required pattern, and of connectors 4 on ends of the ribbon. As FIG. 1 shows, the ribbon 1 is bent at the angle 120°. Diameter of ribbon bending equals practically zero. Bending places 3 are disposed on the ribbon sections 2 subjected to additional processing.

The present invention depicts also structures, which do not contain adhesive materials for fastening of the electrical heating resistance ribbon to any support material, because the adhesive materials provoke different swellings during molding, impregnation, pressing, vulcanization and other processing. Besides, in the present invention the electrical heating resistance ribbon is coated by liquid or spray separating layer selected of group of fluoropolymer mold releases, and this ribbon with connectors forms a heating device adapted for molding by melting inorganic (as gypsum, concrete, cement) and polymer (as resins, silicone or rubber) mass.

FIG. 4, FIG. 5, FIG. 6 and FIG. 7 illustrate and confirm above-mentioned conclusions.

Figure 4:
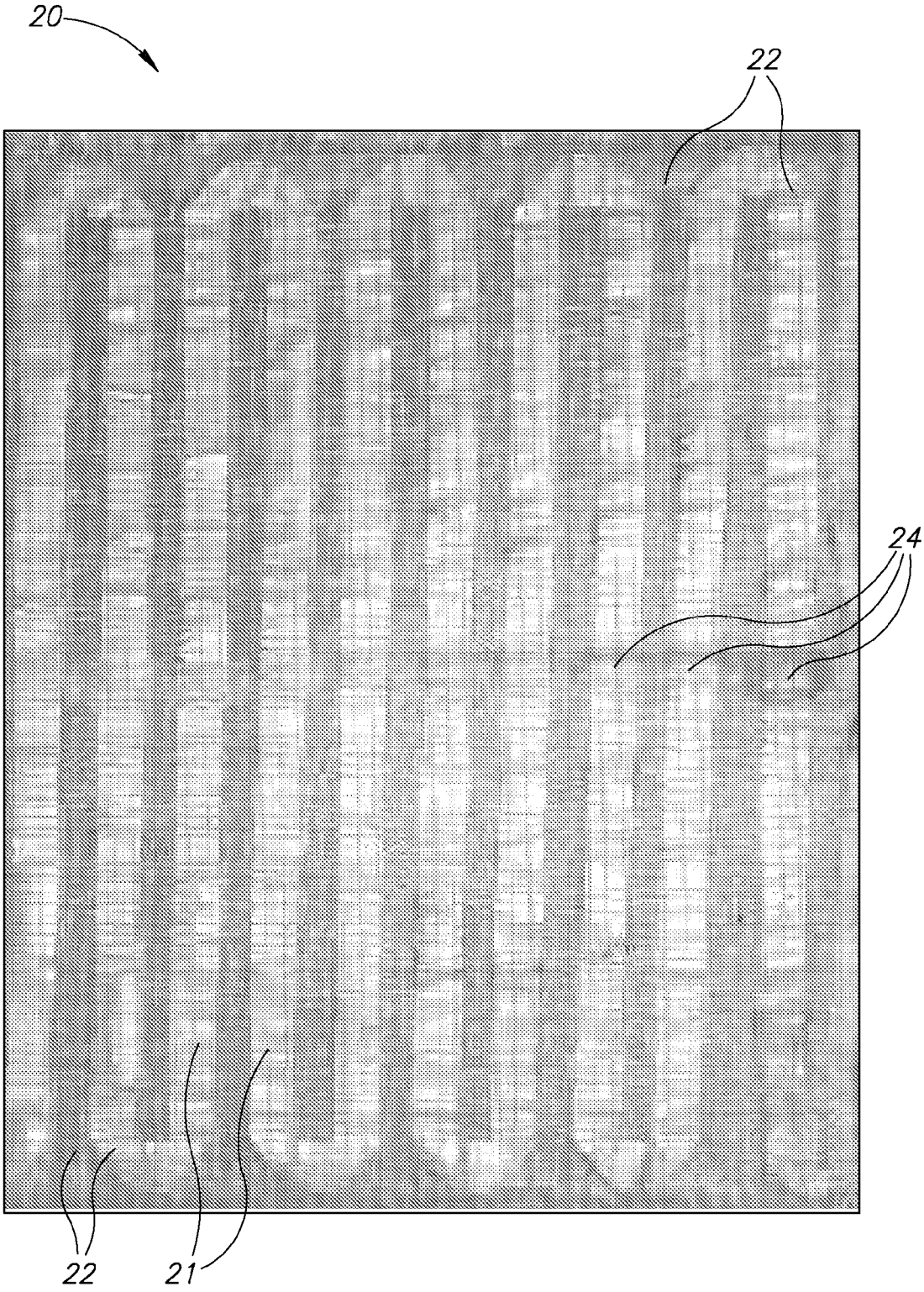
FIG. 4 is photocopy of one example of a silicone heater, made of a heating ribbon fastened to mesh by adhesive ribbon and bound with silicone layers
Figure 5:
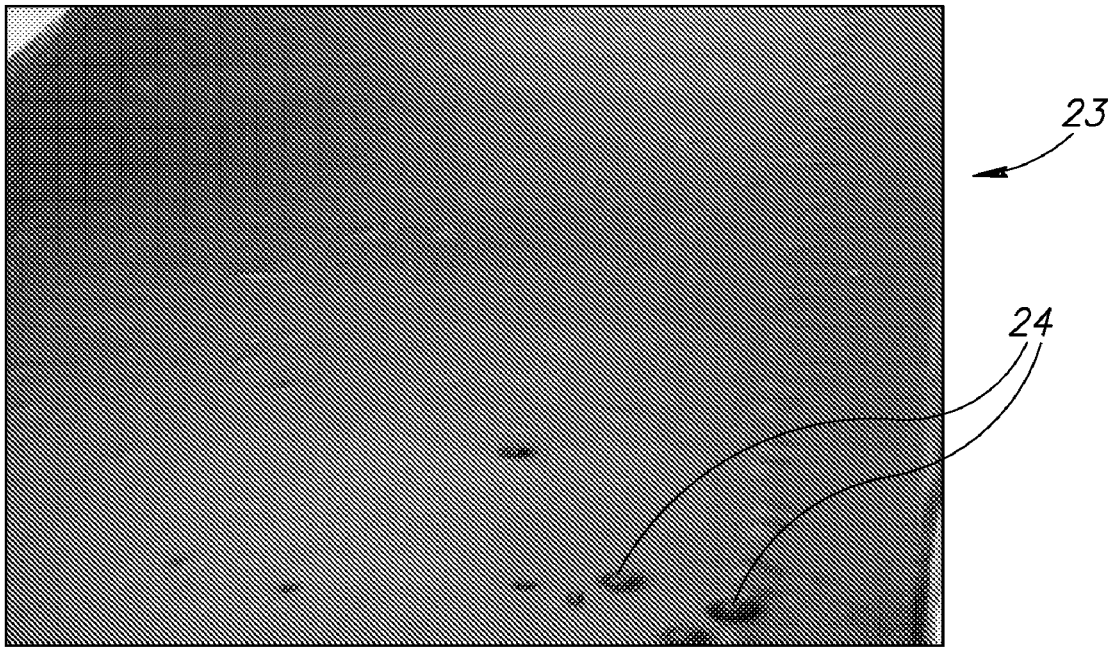
FIG. 5 is photocopy of the second example of a silicone heater made of a heating ribbon fastened to mesh by adhesive ribbon.
Figure 6:
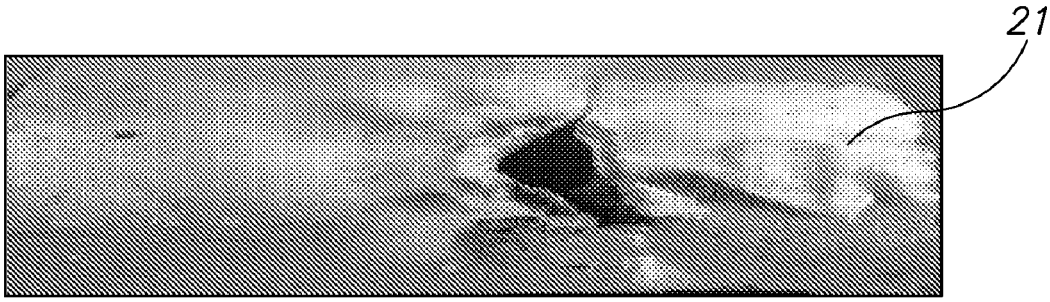
FIG. 6 is photocopy of the third example of a silicone heater where metal heating ribbon bound with silicone and burned out.

FIG. 4 shows one example of silicone heater 20, which is made very incorrectly. As distinct from the present invention, in this silicone heater the heating ribbon 21 is fastened by glued tapes 22 and bound with silicone layer during hot pressing process (the upper layer of silicone is transparent). FIG. 5 shows the other sample of silicone heater 23 made with using of adhesive materials. Along these glued tapes plurality of swellings 24 were formed. Such swellings are very dangerous: in these places probability of the heating ribbon destroying is very high. FIG. 6 shows the heating ribbon burned out after several hours of heater operating because the heating ribbon was bound with silicone mass.

Figure 7:
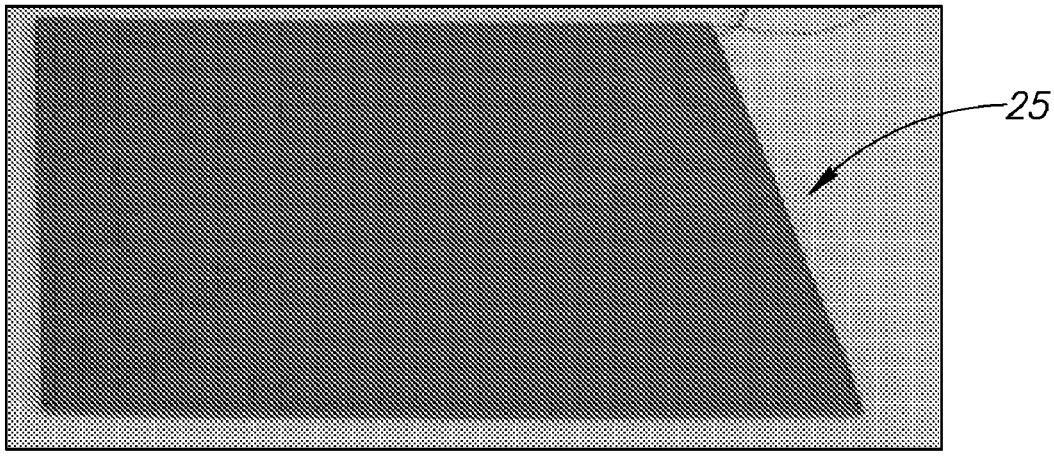
FIG. 7 is photocopy of silicone heater made according the methods described in the present inventions

FIG. 7 shows silicone heater 25 made according the methods of presented invention. After thousands hours of operating swellings did not arise, and the electrical heating resistance ribbon did not destroyed.

Thus, the present invention proposes the heating devices on base of the electrical heating resistance ribbon, which do not contain adhesive tapes as a fastening material. Possibility to produce the heating devices, wherein the electrical heating resistance ribbons are not fastened by any adhesive materials, is reached due to proposed method of the heating devices manufacturing.

In accordance with this method, the electrical heating resistance ribbon, coated or not coated, is arranged in any required pattern without fastening to any support material by the following steps: laying of packaging materials (for example, paper sheet) or/and support materials (for example, mesh, plastic sheet, etc) on electromagnetic table; switching on of the electromagnetic table; laying of the heating ribbon on packaging or/and support material in required pattern; laying of the second layer of support materials; switching off of the electro-magnetic table; transportation of the packaging or/and support materials for subsequent processing (coating, molding, impregnation, pressing, vulcanization) and laying of the materials for following element.

The mesh may be used as a support material. In this case the mesh may be coated by fluoropolymer mold releases and by liquid or spray selected of rubber group. These coatings fasten mesh layers, but do not fill mesh holes and do not prevent to further forming of heating devices.

Described heating element with the electrical heating resistance ribbon, coated or not coated, with mesh or without it, may be placed in different structures, forming different flexible heating devices: silicone, rubber raw material, flexible rubber magnet sheets, thermoplastic polymer. In the case of using of flexible rubber magnet sheets as support material, these flexible rubber magnet sheets may be used for mounting of the electrical heating resistance ribbon instead magnet table.

The heating devices on base of the electrical heating resistance ribbon, both with mesh and without it, may be built also by molding with different polymer mass (for example, epoxy or polyester resins). This resin with reinforced materials (for example, fiber glass mat) or with filler (for example, sand) forms also electrical insulating layer. High quality heating device containing the electrical heating resistance ribbon and a fiber reinforced polymer may be obtained by molding and subsequent pressing.

The electrical heating resistance ribbon coated by liquid or spray substance selected of group of fluoropolymer mold releases, may be covered by thermoplastic polymer (for example, PVC, polyethylene) forming a long linear heating strip. This covering is realized during laminating process. The thermoplastic jacket may be made also of one or more extruded layers.

The described heating element on base of the electrical heating resistance ribbon, coated or not coated, with mesh or without it, may be placed also on rigid base (for example, ceramics, gypsum panels, rigid plastic panels, natural and synthetic marble, metal sheets etc.) and fastened by resin.

Such heaters may contain also two rigid sheets fastened by any resin (for example, epoxy or polyester).

Figure 8:
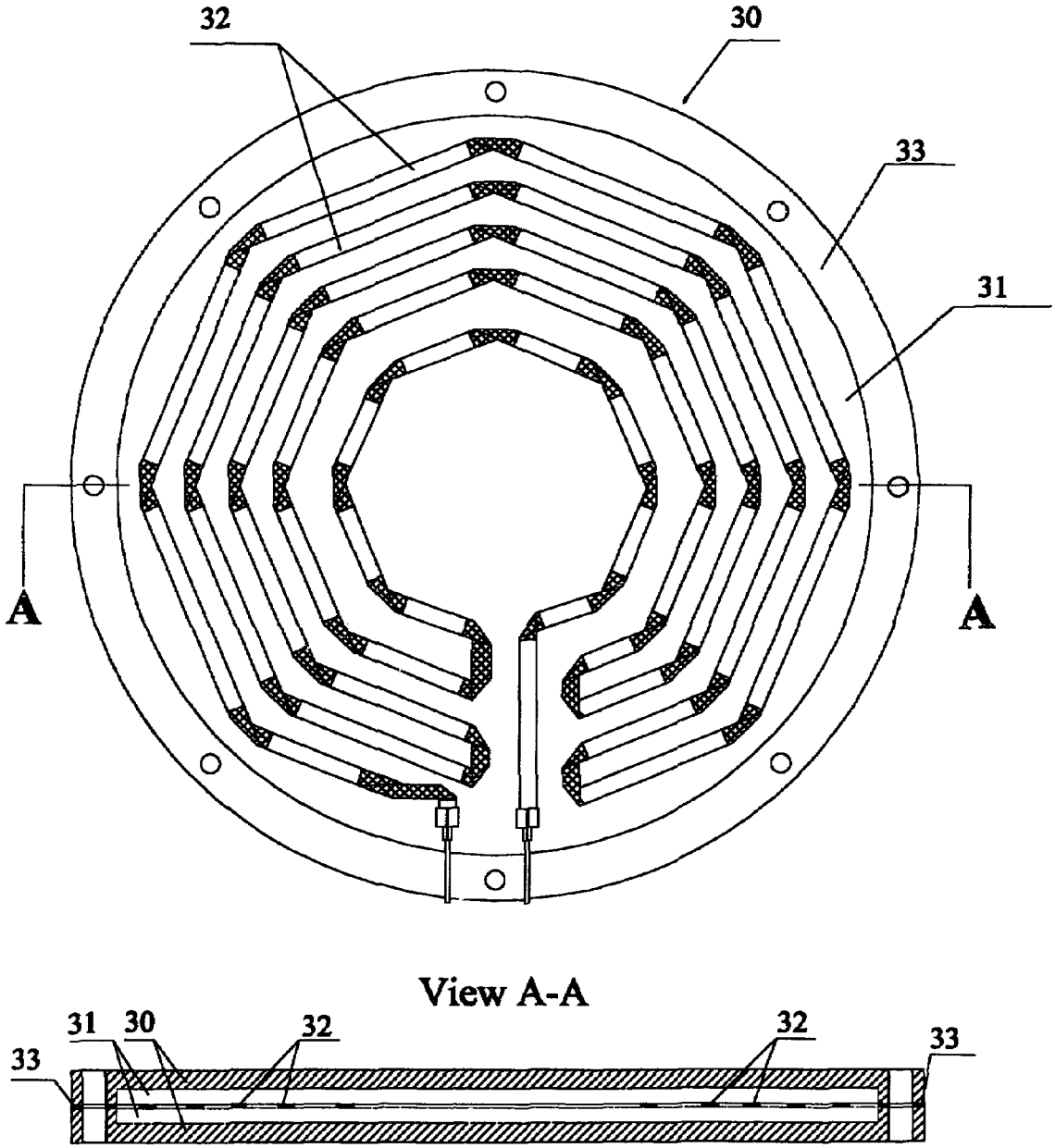
FIG. 8 is schematic top view of a metal plate with powder insulating coating and the electrical heating resistance ribbon arranged in wishful pattern.

FIG. 8 shows a metal plate 30 with powder coating 31 and the electrical heating resistance ribbon arranged in wishful pattern 32. The electrical heating device contains two such metal plates. The plates are fastened between them and sealed by a gasket 33, forming electrical heating devices for warming of air in thermo-ventilator, water heating in tanks, warming of food, etc.

The invention has been described in an illustrative manner, and it is to be understood that the terminology, which has been used, is intended to be in the nature of words of description rather than of limitation. Clearly, many modifications and variations of the present invention are possible in light of the above teachings. Accordingly, it is to be understood that the invention can practiced otherwise than specifically described.

The invention claimed is:

1. An electrical heating device, comprising:

an electrical heating resistance ribbon made from a crystalline cold rolled metal foil formed of a high resistive alloy, said foil having a thickness of 100 microns or less, and said ribbon devoid of any electro-conductive coating thereon and having at predetermined intervals alternating regions of relatively high and low plasticity, said regions of high and low plasticity of predetermined sizes, said high plasticity regions being characterized by allowing bending and pressing of said ribbon at angles from 0° to 180°, and allowing pressing at any angle with a radius of ribbon bending down to zero, said electrical heating resistance ribbon having sufficient strength so that it is capable of being reused and re-bent at regions of previous bends; and connectors for coupling to said ribbon for enabling connection of said ribbon to a power source.

2. An electric heating device according to claim 1, wherein said regions of enhanced plasticity are produced by subjecting said ribbon to a thermal plasticizing process, the process including non-contact inductive high-frequency current thermal treatment, wherein the specific power of electromagnetic energy applied to said ribbon is within 2-6 $W/cm^2$, and the duration of the thermal treatment is not less than 0.1 sec. per cm of the ribbon section length.

3. An electrical heating device according to claim 1, wherein said electrical heating resistance ribbon is arranged in any desired pattern and is positioned between two layers of mesh, said device further comprising a first coat formed of a non-sealing substance selected from a group of fluoropolymer mold releases positioned on a side of each of said mesh layers distal from said ribbon, a portion of said mold release penetrating the interstices of said mesh, and a second coat of a non-sealing substance selected from a group of rubber substances positioned on a side of each of said mold release coats distal from said ribbon, a portion of said rubber substance penetrating the interstices of said mesh.

4. An electrical heating device according to claim 1, wherein said electrical heating resistance ribbon is arranged in any desired pattern and is positioned between two layers of insulative material, said material selected from a group of materials consisting of silicone and rubber.

5. An electrical heating device according to claim 1, wherein said electrical heating resistance ribbon is arranged in any desired pattern and said device further includes mesh as a support material placed on each side of said ribbon, said mesh and said ribbon both encapsulated in a polymer mass.

6. An electrical heating device according to claim 1, wherein said electrical heating resistance ribbon is arranged in any desired pattern and said device further includes mesh as a support material placed on each side of said ribbon, said mesh and said ribbon both encapsulated in a fiber reinforced polymer mass.

7. An electrical heating device according to claim 1, wherein said electrical heating resistance ribbon is arranged in any desired pattern and placed between at least two layers of thermoplastic polymer with a glue layer positioned on each side of said ribbon between it and its adjacent polymer layer.

8. An electrical heating device according to claim 1, wherein said heating resistance ribbon is arranged in any desired pattern and is placed between two metal plates, said plates selected from a group of plates having a powder or enamel coating, said plates fastened together and sealed, thereby to allow said device to function in, and heat, water.

9. An electrical heating device, comprising:

an electrical heating resistance ribbon made from a crystalline cold-rolled metal foil formed of a high resistive alloy, said foil having a thickness of 100 microns or less, and said ribbon devoid of any electro-conductive coating thereon and having at predetermined intervals alternating regions of relatively high and low plasticity, said regions of high and low plasticity of predetermined sizes, and said ribbon having a coating of a mold release substance disposed thereon, said mold release substance selected from a group of fluoropolymer mold release agents, said high plasticity regions being characterized by allowing bending and pressing of said ribbon at angles from 0° to 180°, and allowing pressing at any angle with a radius of ribbon bending down to zero, said electrical heating resistance ribbon having sufficient strength so that it is capable of being reused and re-bent at regions of previous bends; and connectors for coupling to said ribbon for enabling connection of said ribbon to a power source.

10. An electrical heating device according to claim 9, wherein said electrical heating resistance ribbon is arranged in any desired pattern and disposed between two layers of insulative material, said material selected from a group of materials consisting of silicone and rubber.

11. An electrical heating device according to claim 9, wherein said electrical heating resistance ribbon is arranged in any desired pattern and said device further includes mesh as a support material disposed on each side of said ribbon, said mesh and said ribbon both encapsulated in a polymer mass.

12. An electrical heating device according to claim 9, wherein said electrical heating resistance ribbon is arranged in any desired pattern and said device further includes mesh as a support material disposed on each side of said ribbon, said mesh and said ribbon both encapsulated in a fiber reinforced polymer mass.

13. An electrical heating device according to claim 9, wherein said electrical heating resistance ribbon is arranged in any desired pattern and disposed between at least two layers of thermoplastic polymer with a glue layer disposed on each side of said ribbon between it and its adjacent polymer layer.

14. An electrical heating device according to claim 9, wherein said electrical heating resistance ribbon is a linear ribbon, laminated to, and covered on each side by, a thermoplastic polymer.

15. An electrical heating device according to claim 9, wherein said electrical heating resistance ribbon is disposed in a thermoplastic multilayered jacket, wherein said multilayered jacket consists of at least two thermoplastic layers, said thermoplastic layers bound together, and said heating resistance ribbon tightly covered by, and not bound to, said thermoplastic layers.

16. An electrical heater device according to claim 9, wherein said heating resistance ribbon is arranged in any desired pattern and is disposed on a rigid base and fastened to said base by a polymer resin disposed on a side of said ribbon distal from said base, said polymer resin forming an insulating layer.

17. An electrical heating device according to claim 9, wherein said heating resistance ribbon is arranged in any desired pattern and is disposed between two metal plates, said plates selected from a group of plates having a powder or enamel coating, said plates fastened together and sealed, thereby to allow said device to function in, and heat, water.

18. An electrical heating device, comprising:

an electrical heating resistance ribbon made from a crystalline cold rolled metal foil formed of a high resistive alloy, said foil having a thickness of 100 microns or less, and said ribbon having at predetermined intervals preheated regions of relatively high plasticity alternating with non-preheated regions of low plasticity, said regions of high and low plasticity of predetermined sizes, said high plasticity regions being characterized by allowing bending and pressing of said ribbon at angles from 0° to 180°, and allowing pressing at any angle with a radius of ribbon bending down to zero, said electrical heating resistance ribbon having sufficient strength so that it is capable of being reused and re-bent at regions of previous bends; and connectors for coupling to said ribbon for enabling connection of said ribbon to a power source.

* * * * *